US007331081B2

(12) United States Patent
Meyers

(10) Patent No.: US 7,331,081 B2
(45) Date of Patent: Feb. 19, 2008

(54) TROWEL BLADE

(75) Inventor: Lawrence G. Meyers, Layton, UT (US)

(73) Assignee: Beno J. Gundlach Company, Belleville, IL (US)

( * ) Notice: Subject to any disclaimer, the term of this patent is extended or adjusted under 35 U.S.C. 154(b) by 757 days.

(21) Appl. No.: 10/817,191

(22) Filed: Apr. 1, 2004

(65) Prior Publication Data

US 2005/0217050 A1 Oct. 6, 2005

(51) Int. Cl.
*B05C 17/10* (2006.01)

(52) U.S. Cl. ..... 15/235.4; 15/245.1

(58) Field of Classification Search ..... 15/235.4, 15/235.5, 235.6, 235.7, 235.8, 245.1, 145
See application file for complete search history.

(56) References Cited

U.S. PATENT DOCUMENTS

| | | | |
|---|---|---|---|
| 550,941 | A | 12/1895 | Carlson |
| 899,653 | A | 9/1908 | Bishop |
| 938,070 | A | 10/1909 | Neerup |
| 963,717 | A | 7/1910 | Linville |
| 1,482,452 | A | 2/1924 | Williams |
| 1,544,368 | A | 6/1925 | Brennan |
| 1,627,410 | A | 5/1927 | Rowley |
| 3,419,297 | A | 12/1968 | Diepenhorst et al. |
| 3,460,183 | A | 8/1969 | Harrington |
| 3,754,319 | A | 8/1973 | Miori |
| 4,822,671 | A | 4/1989 | Carper et al. |
| 5,086,997 | A | 2/1992 | Glass |
| 5,193,244 | A | 3/1993 | Meyers |
| 5,333,348 | A | 8/1994 | Schumacher et al. |
| 6,499,178 | B1 | 12/2002 | Huang |
| 7,213,295 | B2 * | 5/2007 | Chang ..... 15/235.4 |

* cited by examiner

*Primary Examiner*—Randall Chin
(74) *Attorney, Agent, or Firm*—Thorpe North & Western LLP

(57) ABSTRACT

A trowel blade includes a pre-finished, hardened and tempered blade having at least two apertures formed therethrough. Each aperture has a cross section tapering from a larger opening in a bottom of the blade to a smaller opening in a top of the blade. At least two cleats are also provided, each cleat being disposed in one of the apertures and each cleat having a lower portion, deformed within the aperture to have a frusto-conical shape mating with internal walls of the aperture. Each cleat also has an upper, inverted frusto-conical portion having a lower surface mating with an upper surface of the blade, and an upper shoulder. The upper shoulder of the upper portion extends upwardly from the lower surface of the upper portion and outwardly from a longitudinal axis of the cleat. The cleats are formed of an integral, rigid material and are collectively configured to provide a substantially rigid interface between the pre-finished blade and a removable handle of the pre-finished blade.

12 Claims, 5 Drawing Sheets

TROWEL BLADE

BACKGROUND OF THE INVENTION

1. Field of the Invention

The present invention relates generally to trowel blades. More particularly, the present invention relates to trowel blades having engagable cleats attached thereto to receive a removable handle for the blade.

2. Related Art

Trowels are used in a variety of construction applications including flooring installation, tile laying, concrete finishing, etc. As trowels are generally subject to repeated contact with abrasive surfaces or materials, the blade of the trowel is often formed from a substantially hardened blade material, such as hardened steel, to prolong a usable life of the trowel blade. Typically, such materials are hardened and tempered by a steelmaker who tensions continuous strips of the material while subjecting the material to various processes, such as heat extremes and/or chemical treatments introduced into a carefully controlled atmosphere surrounding the strips being treated. The hardened and tempered blade material is then often sold in roll form to trowel manufacturers, who then form individual blades from the roll of sheet material. As the hardening and tempering of the blade material is generally done on a large scale, it is not generally feasible to harden and temper the blade material prior to forming individual trowel blades.

During the individual trowel blade manufacturing and assembly process, the trowel manufacturer generally cuts the rolls of strip material provided by the steelmaker into single, substantially rectangular blades. The trowel manufacturer also must generally attach some type of handle to each of the blades, to provide an interface for a user of the trowel. In some applications, engagement cleats are coupled to or with the blade to allow a handle to be removably attached to the blade. As the individual blades have already been hardened and tempered prior to attaching of a handle, this handle attachment process has proved problematic.

For example, many attachment methods require or create the presence of heat. If a handle is welded to the blade, the heat from the welding process can disturb the heat-treated surface of the blade, causing the blade to warp, become too brittle and fracture, and/or to lose its hardness. In addition, during the hardening of the blade material, grain structure is often formed on or beneath the surface of the blade material which provides a finished, "brushed" appearance to the blade material. Maintaining the finished surface can be important to trowel manufacturers, as the finished surface can limit corrosion of the blade and can hide "smudge" marks or fingerprints on the blade. Thus, in addition to compromising the structural integrity of the blade, welding can mar the surface finish of the hardened blade, undoing much of the work performed in the controlled hardening process. Repairing or concealing such damage to the blade can be extremely difficult.

These problems associated with attempting to weld a handle or engagement cleat to the blade are also significant if grinding or other machining processes are performed on the trowel blade when attempting to attach a handle.

For these reasons, attempts have been made to attach handles or cleats using processes that do not require or generate heat. One such attempt involves the use of rivet fasteners which either attach a handle to the blade or attach cleats to the blade for removably receiving a handle. In particular, rivets have been used to attach plastic cleats to a trowel blade, as described in U.S. Pat. No. 5,193,244, which is herein incorporated by reference. In this process, a dimple is generally first formed in the trowel blade. A rivet is then inserted through a bottom of the blade in the dimple and through a plastic cleat protruding above the trowel blade. The rivet is then deformed into a top of the plastic cleat.

While this system has met with some degree of success, it has been found that the trowel blade is often deformed outside of the area of the dimple when forming the initial dimple, causing the blade to have surface irregularities that lead to gaps formed between the removable handle and the blade. The gaps can allow adhesives and other materials to seep between the blade and the handle.

In addition, the system disclosed in U.S. Pat. No. 5,193,244 relies on a lower, pre-formed rivet head that is seated within the dimple below the blade. In the case where the pre-formed rivet head does not precisely match the geometry of the dimple, the cleat can be cocked with respect to the blade, as the pre-formed rivet head may become cocked within the dimple and distort the plastic cleat upon deformation of the rivet in the plastic cleat. In addition the pre-formed rivet head may extend below the lower surface of the trowel blade, possibly interfering with the application in which the trowel is to be used.

SUMMARY OF THE INVENTION

It has been recognized that it would be advantageous to develop a system for removably attaching a handle to a trowel blade to provide a consistent interface between the blade and the handle. In addition, it has been recognized that it would be advantageous to develop a system for removably attaching a handle to a trowel blade in a manner that does not adversely affect the hardened and tempered properties of the trowel blade.

The invention provides a trowel blade, including a pre-finished, hardened and tempered blade having at least two apertures formed therethrough. Each aperture can have a cross section tapering from a larger opening in a bottom of the blade to a smaller opening in a top of the blade. At least two cleats can also be provided, each cleat can be disposed in one of the apertures and each cleat can have a lower portion, deformed within the aperture to have a frusto-conical shape mating with internal walls of the aperture. Each cleat can also have an upper, inverted frusto-conical portion having a lower surface mating with an upper surface of the blade, and an upper shoulder. The upper shoulder of the upper portion can extend upwardly from the lower surface of the upper portion and outwardly from a longitudinal axis of the cleat. The cleats can be formed of an integral, rigid material and can be collectively configured to provide a substantially rigid interface between the pre-finished blade and a removable handle of the pre-finished blade.

In accordance with another aspect of the present invention, a trowel blade is provided, including a pre-finished, hardened and tempered blade having at least two apertures formed therethrough. Each aperture can be circumscribed by an upwardly protruding dimple formed in the pre-finished blade. At least two cleats can also be provided, each cleat being disposed in one of the apertures and each cleat having a lower portion, deformed within the dimple to have a frusto-conical shape mating with a bottom surface of the dimple. Each cleat can also have an upper, inverted frusto-conical portion having a lower surface mating with a top surface of the dimple, and an upper shoulder. The upper shoulder can extend upwardly from the lower surface of the upper portion of the cleat and outwardly from a longitudinal axis of the cleat. The cleats can be formed of an integral, rigid material and can be collectively configured to provide a substantially rigid interface between the pre-finished blade and a removable handle of the pre-finished blade.

In accordance with another aspect of the present invention, a method of providing an interface between a trowel blade and a removable handle is provided, including the steps of: obtaining a pre-finished, hardened and tempered blade; forming at least two apertures through the pre-finished blade, each of the apertures having a cross section tapering from a larger opening in a bottom of the blade to a smaller opening in a top of the blade; disposing a lower, deformable portion of one of at least two cleats through each of the apertures; and deforming the lower portion of each of the cleats within each aperture such that the lower portion of each cleat mates with internal walls of the apertures.

In accordance with another aspect of the present invention, a method of providing an interface between a trowel blade and a removable handle is provided, including the steps of: obtaining a pre-finished, hardened and tempered blade; forming at least two apertures through the pre-finished blade; forming an upwardly protruding dimple about each of the apertures formed through the blade; disposing a lower, deformable portion of one of at least two cleats through each of the apertures; and deforming the lower portion of each of the cleats within each dimple such that the deformed lower portion mates with a bottom surface of the dimple.

Additional features and advantages of the invention will be apparent from the detailed description which follows, taken in conjunction with the accompanying drawings, which together illustrate, by way of example, features of the invention.

DETAILED DESCRIPTION

Figure 1A:
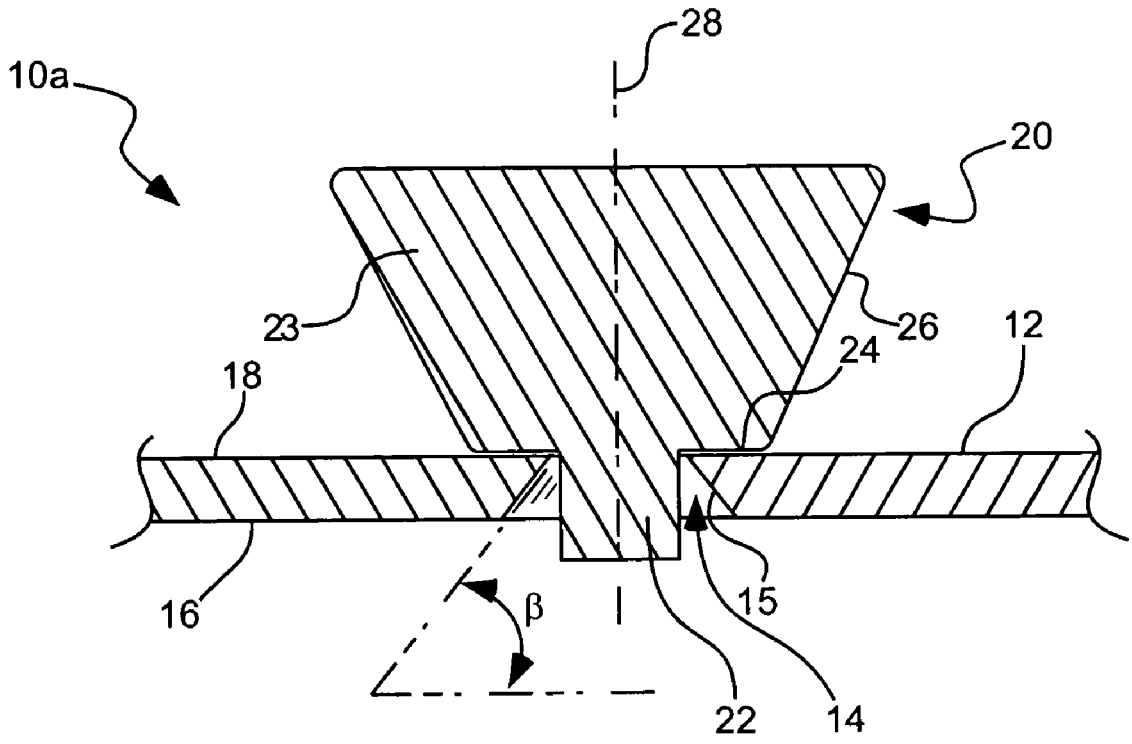
FIG. 1A is a partial side, sectional view of a trowel blade and cleat in accordance with an embodiment of the present invention.

Reference will now be made to the exemplary embodiments illustrated in the drawings, and specific language will be used herein to describe the same. It will nevertheless be understood that no limitation of the scope of the invention is thereby intended. Alterations and further modifications of the inventive features illustrated herein, and additional applications of the principles of the inventions as illustrated herein, which would occur to one skilled in the relevant art and having possession of this disclosure, are to be considered within the scope of the invention.

Figure 1B:
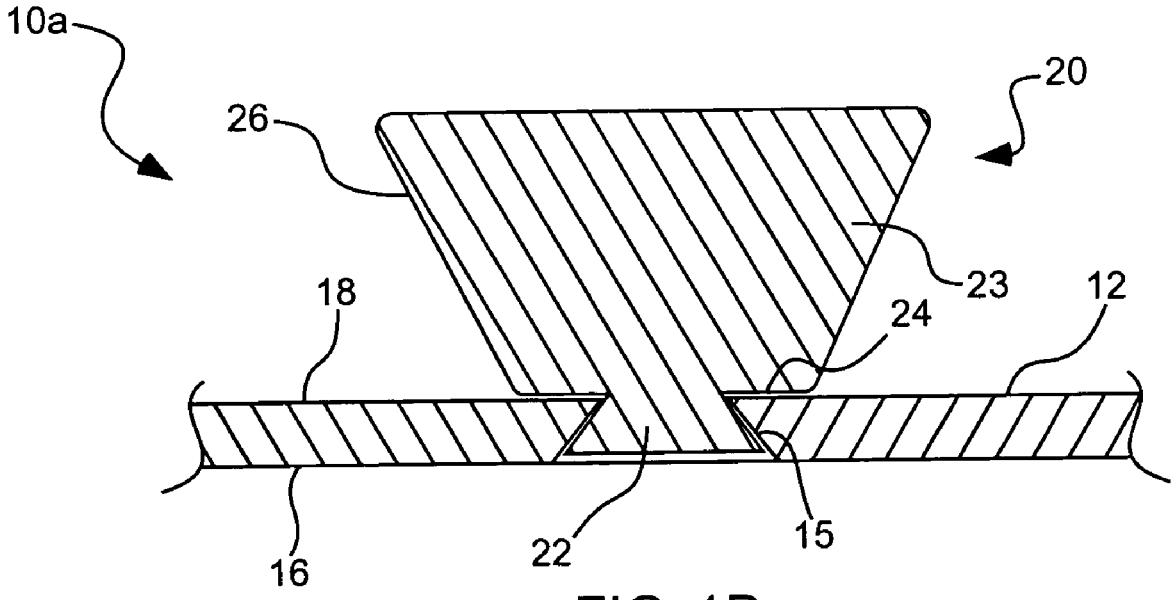
FIG. 1B is a partial side, sectional view of the trowel blade and cleat of FIG. 1A, after deformation of a lower portion of the cleat.

As illustrated in FIGS. 1A and 1B, a system, indicated generally at 10*a*, in accordance with the present invention is shown for a trowel blade. The system includes a pre-finished, hardened and tempered blade 12 that can have one or a plurality of apertures 14 formed therethrough. Each aperture can have a cross section tapering from a larger opening in a bottom 16 of the blade to a smaller opening in a top 18 of the blade.

Figure 2:
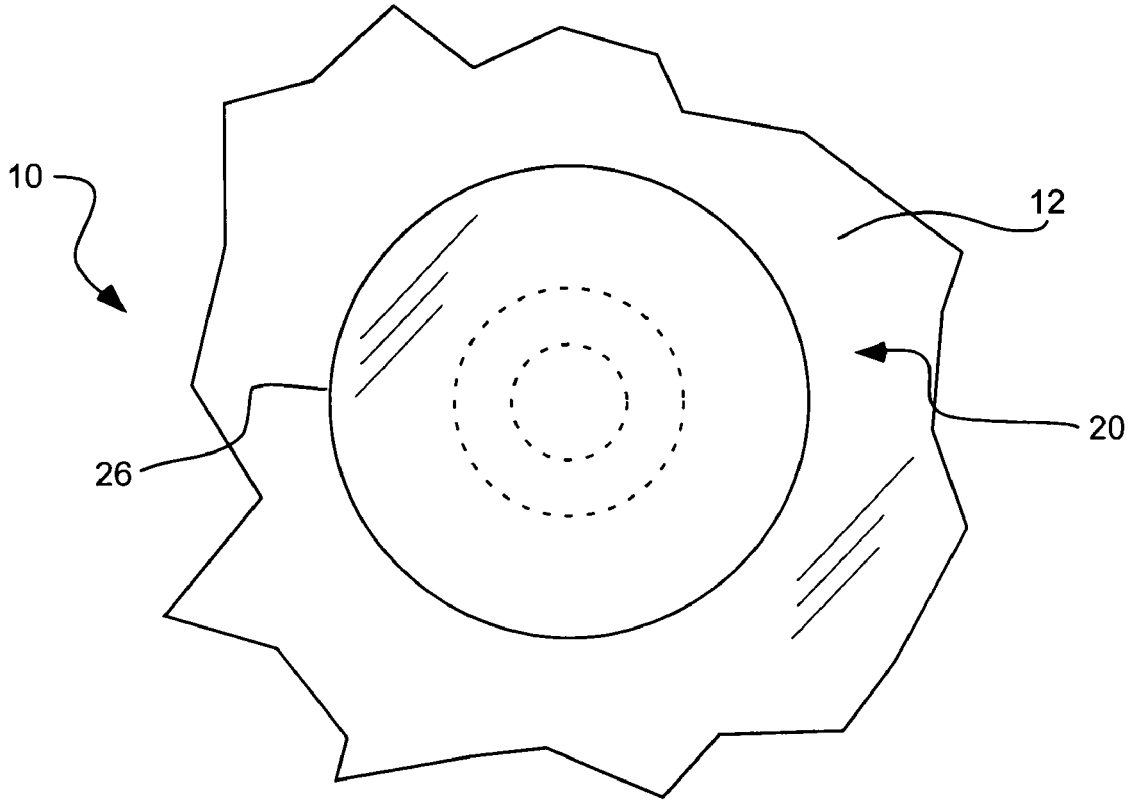
FIG. 2 is a partial top view of a trowel blade and cleat in accordance with an aspect of the invention.

A cleat 20 can be disposed in each of the apertures. Each cleat can have a lower portion 22, deformed or deformable within the aperture 14 to have a frusto-conical shape mating with internal walls 15 of the aperture (see FIG. 1B). Each cleat can also include an upper, inverted frusto-conical portion 23 having a lower surface 24 mating with the upper or top surface 18 of the blade. The upper portion of the cleat can also include an upper shoulder 26 extending upwardly from the lower surface of the upper portion and outwardly from a longitudinal axis 28 of the cleat. In one aspect of the invention, the upper portion of the cleat terminates in a generally circular shape, as shown for example in top view in FIG. 2.

Figure 4:
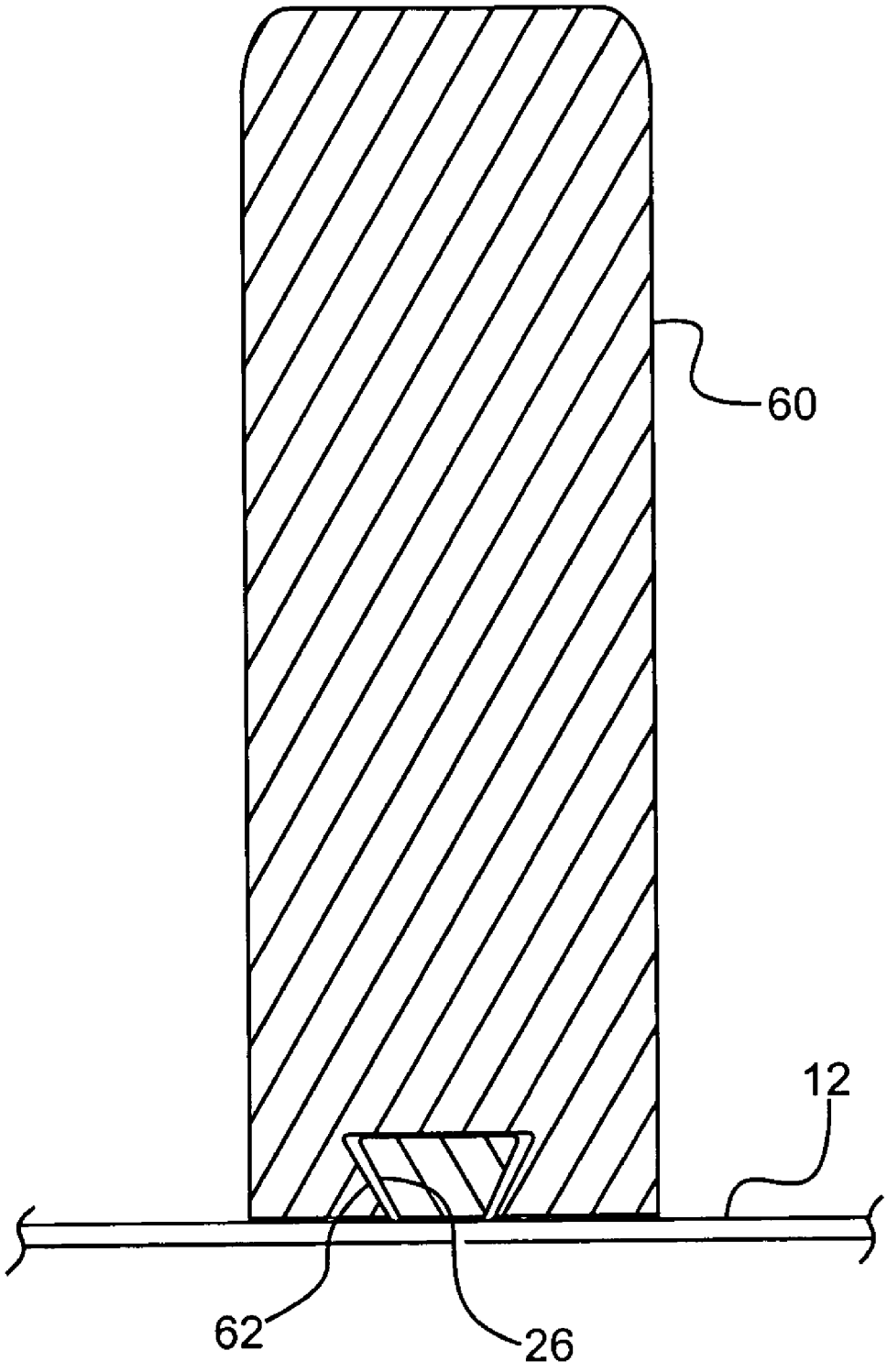
FIG. 4 is a partial, sectional end view of a trowel blade and cleat with a removable handle engaged with the cleat in accordance with an aspect of the invention.

The cleats 20 can each be formed of an integral, rigid material and can be collectively configured to provide a substantially rigid interface between the pre-finished blade 12 and a removable handle (60 in FIG. 4) of the pre-finished blade. As used herein, the term "integral" is to be understood to mean continuous or uninterrupted, as opposed to, for example, a material formed of two or more sections. As shown in FIG. 4, once disposed within the pre-finished blade, the upper shoulder 26 of the cleat 20 can be engaged by a notch 62 of a removable handle 60 to secure the handle to the blade. As will be appreciated, multiple cleats can be arranged linearly to form a row of cleats (which would extend into the page of FIG. 4) which can each engage a notch or channel within the handle. Such a configuration is described in U.S. Pat. No. 5,193,244, which is incorporated herein by reference.

The material of which the cleats 20 and the pre-finished, hardened and tempered blade are formed can include a range of materials known to those in the art. In one aspect of the invention, the pre-finished blade can be formed of high-carbon steel with a hardness on the order of 47-48 Rockwell C Hardness ("RCH"). The cleat can be formed of a relatively softer steel with a hardness of 37-38 RCH. While the cleat can be formed of a softer material than the blade, the cleats of the present invention are substantially rigid to provide a rigid interface between the cleat and the blade when the cleat is deformed in the blade.

Figure 1C:
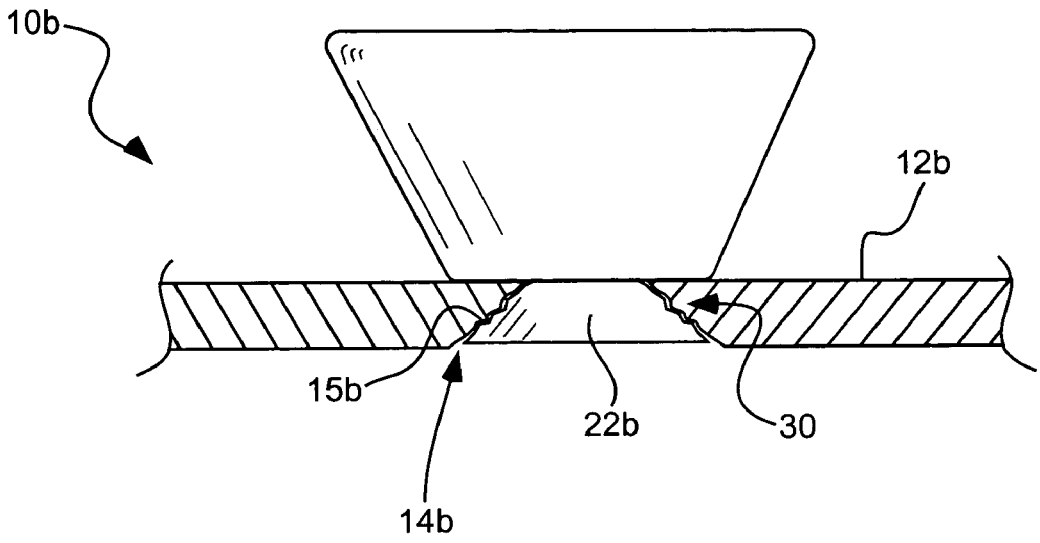
FIG. 1C is a partial side, sectional view of another trowel blade and cleat, after deformation of a lower portion of the cleat, in accordance with an aspect of the invention.

As shown in FIG. 1C, in one aspect of the invention, a series of irregularities 30 can be formed in the internal sides 15*b* of the aperture 14*b*. The irregularities can be configured to engage the lower portion 22*b* of the cleat when the lower portion is deformed within the aperture. In this manner, rotation of the lower portion within the aperture is resisted or limited. This feature can be advantageous in that, upon deforming the lower portion of the cleat within the aperture, the lower portion will generally mate with or conform to internal sides of the apertures. As the internal sides of the aperture may not be formed in a perfectly symmetrical configuration, the deformed lower portion of the cleat may have a particular geometry, i.e., one side may be formed at more of an angle with respect to, or with a longer length than, another side. Thus, if the cleats turn within the aperture after deformation, the cleat may become "cocked," resulting in the upper portion of the cleat becoming cocked relative to the blade. This in turn can cause an improper fit between the handle and the blade.

As shown in FIG. 1B, in one aspect of the invention, the deformed lower portion 22 of the cleats can be contained substantially fully between a plane defined by the top surface 18 of the pre-finished blade and a plane defined by the bottom surface 16 of the pre-finished blade. In addition, in one aspect of the invention, a lower surface of the lower portion 22 of the cleats can be recessed in the aperture above a plane defined by the bottom of the pre-finished blade. In one embodiment, the lower surface of the lower portion of the cleats can be parallel to, or flush with, a plane defined by a bottom of the pre-finished blade.

The aperture 14 can be formed in a variety of configurations, and can include a cross section that tapers from a smaller opening in a top of the blade to a larger opening in a bottom of the blade. As shown in FIG. 1A, the size of the openings in the top 18 and bottom 16 of the blade can vary to affect an angle β at which the internal walls of the aperture vary with respect to the bottom of the blade. In one aspect of the invention, the angle β can be on the order 85° to 95° with respect to the bottom of the blade.

Figure 3A:
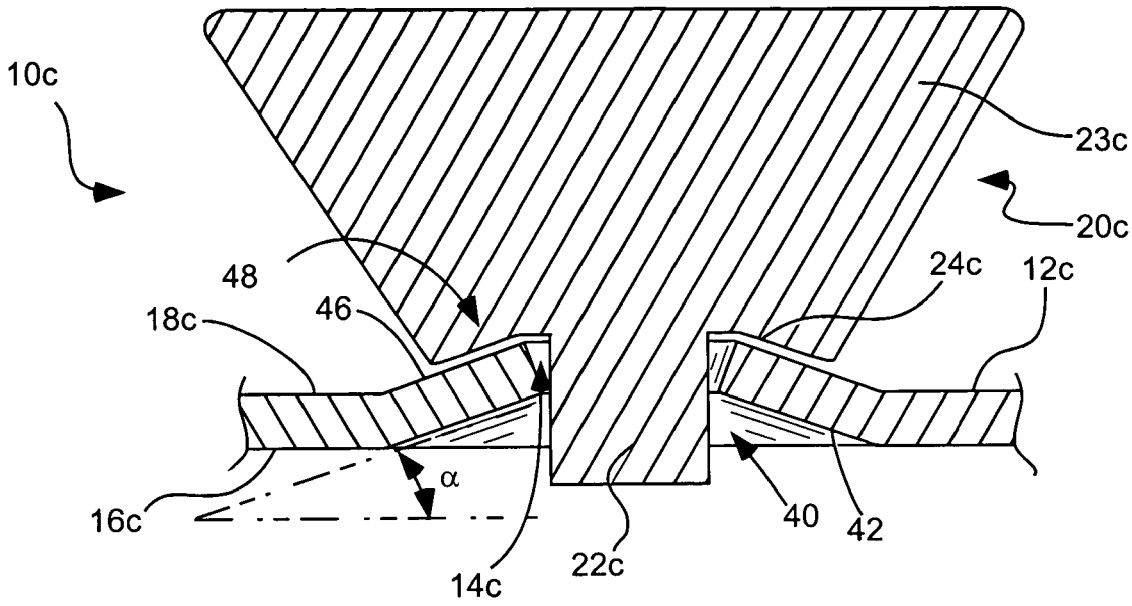
FIG. 3A is a partial side, sectional view of a trowel blade and cleat in accordance with another embodiment of the present invention.
Figure 3B:
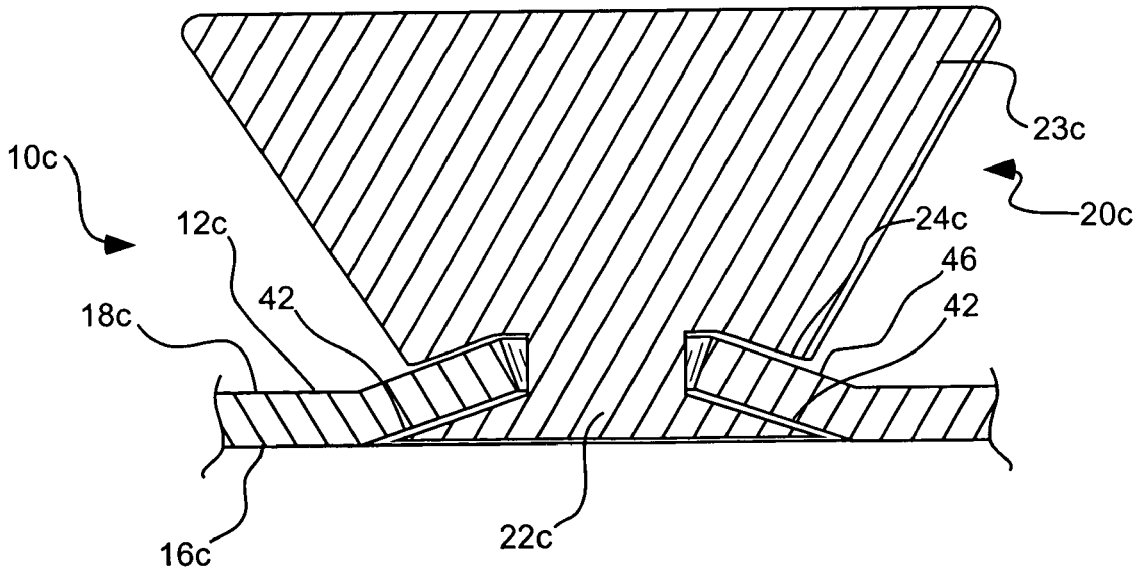
FIG. 3B is a partial side, sectional view of the trowel blade and cleat of FIG. 3A, after deformation of a lower portion of the cleat.

Turning now to FIGS. 3A and 3B, another embodiment of the invention is shown, wherein trowel blade 10*c* includes a pre-finished, hardened and tempered blade 12*c* having at least one aperture 14*c* formed therethrough. Each aperture can be circumscribed by an upwardly protruding dimple 40 formed in the pre-finished blade. A cleat 20*c* can be disposed in each aperture. Each cleat can have a lower portion 22*c*, deformed within the dimple to have a frusto-conical shape mating with a bottom surface 42 of the dimple. Each cleat can also have an upper, inverted frusto-conical portion 23*c* having a lower surface 24*c* mating with a top surface 46 of the dimple. Each cleat can also include an upper shoulder 26*c* extending upwardly from the lower surface of the upper portion and outwardly from a longitudinal axis (28 in FIG. 1A) of the cleat.

As in other embodiments, the cleats 20*c* can be formed of an integral, rigid material and can be collectively configured to provide a substantially rigid interface between the pre-finished blade 12*c* and a removable handle of the pre-finished blade. As shown in FIG. 3B, in one aspect of the invention, the deformed lower portion 22*c* of the cleats can be contained substantially fully between a plane defined by a top surface 18*c* of the pre-finished blade and a plane defined by a bottom surface 16*c* of the pre-finished blade. Also, a lower surface of the lower portion of the cleats can be disposed in the dimple above the plane defined by the bottom of the pre-finished blade. In one embodiment, the lower surface of the lower portion of the cleats can be parallel to, or flush with, the plane defined by the bottom of the pre-finished blade.

The upper portion 23*c* of each cleat 20*c* can include an internal, tapered recess 48 which defines the lower surface 24*c* thereof. The internal, tapered recess can mate with the top surface 46 of the upwardly protruding dimple 40 formed in the pre-finished blade. The bottom surface 42 of the dimple can be formed in a variety of angles α with respect to the bottom surface 16*c* of the blade 12*c*. In one aspect, the angle α is on the order of about 20° with respect to the bottom 16*c* of the blade 12*c*.

In each of the embodiments discussed above, the cleats 20 can be deformed within the apertures 14 or dimples 40 in a variety of manners. In one aspect, the cleats can be deformed within the aperture or the dimples by applying force to both the upper and lower portions of the cleat in order to deform the lower portion of the cleat without heating the blade. This feature is advantageous in that a secure interface is provided between the cleats and the blade without introducing significant heat to the process, which might otherwise comprise the heat treated properties of the blade.

The cleats 20 can be deformed within the apertures 14 or dimples 40 in a tensioned state, such that the cleats are held substantially immobile with respect to the blade 12. In one embodiment, the cleats are clinched with the bottom and top of the blade, or the bottom and top of the dimples, to add rigidity to a portion of the blade surrounding the cleats. These features of the invention can be appreciated by consideration of FIGS. 5A and 5B.

Figure 5A:
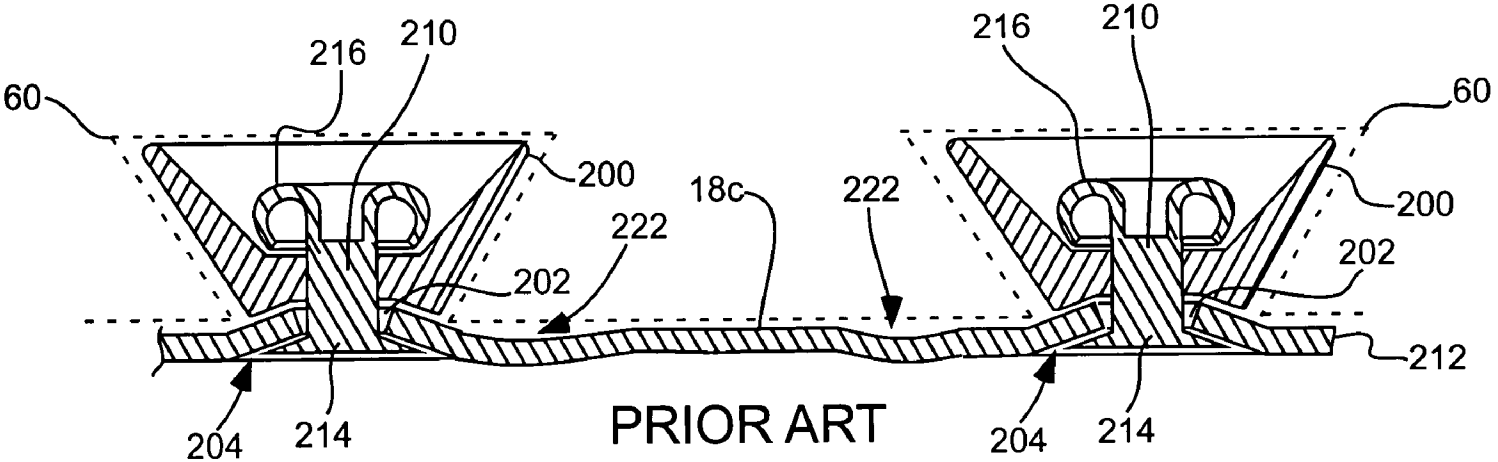
PRIOR ART FIG. 5A
FIG. 5A is a partial side, sectional view of a prior art trowel blade and cleat system.

FIG. 5A illustrates a prior art method of attaching plastic buttons 200 to a hardened blade 212. In this process, apertures 202 are generally first formed in the blade, after which dimples 204 are formed in the blade around the apertures. Plastic buttons 200 are then disposed above the apertures and dimples, and a rivet 210 is disposed through the aperture and button, with a pre-formed rivet head 214 disposed in the dimple below the blade. A top 216 of the rivet is then deformed within the button to hold the plastic button relative to the blade.

As shown in FIG. 5A, it is often the case that forming the dimples 204 in the hardened blade 212 also results in slightly deforming portions of the blade adjacent the dimples such that surface waves 222 are formed in the blade. Once formed, these surface waves result in gaps being formed between the removable handle 60 and the top 18*c* of the blade. Such gaps can be disadvantageous in that material, such as water, adhesive, mortar, etc., can seep into the gaps and compromise the detachable interface between the blade and the handle.

Figure 5B:
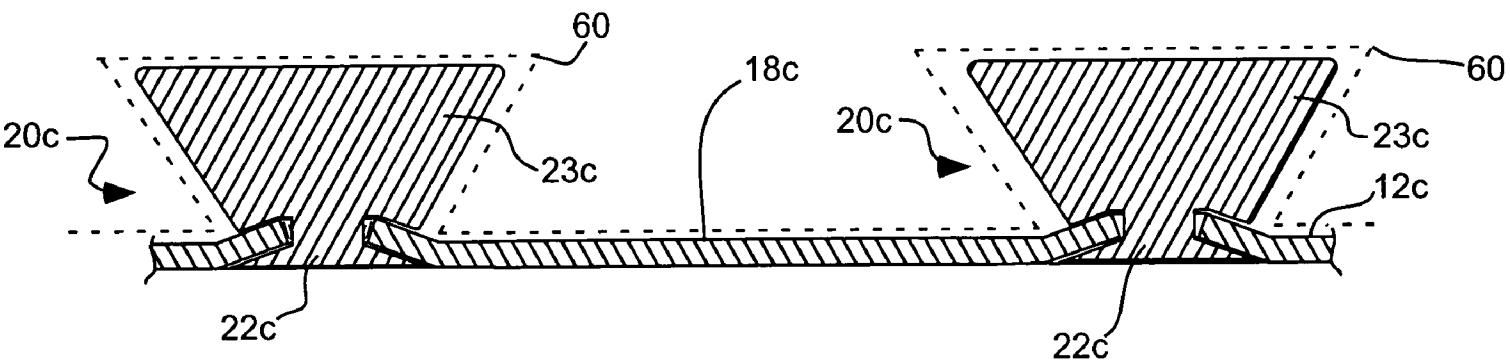
FIG. 5B is a partial side, sectional view of a trowel blade and cleats in accordance with an aspect of the present invention.

The present invention advantageously addresses this problem by providing a secure interface between the cleats and the blade. By clinching the cleats within the apertures or dimples, or by deforming the cleats within the apertures or dimples in a tensioned state, the cleats act on the blade 12 and provide a restraining force which adds rigidity to the blade. As can be seen in FIG. 5B, the cleats clinch or grip the blade such that surface waves that may have been formed in the blade during formation of the dimples are pulled substantially flat. Thus, the handle 60 and the blade 12*c* of FIG. 5B contact each other to form a substantially constant seal along the handle when the handle engages the cleats. This seal serves to limit or resist material from seeping between the blade and the handle.

The present invention also includes a method utilizing the structure disclosure above for providing an interface between a trowel blade and a removable handle. The method can include the steps of: obtaining a pre-finished, hardened and tempered blade; forming at least two apertures through the pre-finished blade, each of the apertures having a cross section tapering from a larger opening in a bottom of the blade to a smaller opening in a top of the blade; disposing a lower, deformable portion of one of at least two cleats through each of the apertures; and deforming the lower portion of each of the cleats within each aperture such that the lower portion of each cleat mates with internal walls of the apertures.

The step of forming the at least two apertures through the pre-finished blade can include the further step of forming a series of irregularities in internal sides of the apertures, the irregularities being configured to engage the lower portion of the cleat to resist rotation of the cleat within the aperture. The step of deforming the cleats can include the step of tensioning the cleats within the aperture such that the cleats are held substantially immobile with respect to the blade. The step of deforming the cleats can also include the step of clinching the bottom and top of the blade with the cleats to add rigidity to a portion of the blade surrounding the cleats. The step of disposing the cleats within the apertures can include the step of inserting the cleats through the smaller opening in the top of the blade.

As illustrated in FIGS. 1A and 3A, the lower portion of each cleat can be substantially cylindrical prior to deformation. The lower portion of each cleat can also be a solid cylinder prior to deformation. As illustrated in FIG. 4, the method can include the further step of removably attaching a removable handle to the at least two cleats by engaging the cleats within notches in the handle.

In another aspect of the invention, a method of providing an interface between a trowel blade and a removable handle is provided, including the steps of: obtaining a pre-finished, hardened and tempered blade; forming at least two apertures through the pre-finished blade; forming an upwardly protruding dimple about each of the apertures formed through the blade; disposing a lower, deformable portion of one of at least two cleats through each of the apertures; and deforming the lower portion of each of the cleats within each dimple such that the deformed lower portion mates with a bottom surface of the dimple.

It is to be understood that the above-referenced arrangements are illustrative of the application for the principles of the present invention. It will be apparent to those of ordinary skill in the art that numerous modifications can be made without departing from the principles and concepts of the invention as set forth in the claims.

What is claimed is:

1. A trowel blade, comprising:

a pre-finished, hardened and tempered blade having at least two apertures formed therethrough, each aperture having a cross section tapering from a larger opening in a bottom of the blade to a smaller opening in a top of the blade;

at least two cleats, each cleat being disposed in one of the apertures and each cleat having:

a lower portion, deformed within the aperture to have a frusto-conical shape mating with internal walls of the aperture; and an upper, inverted frusto-conical portion having a lower surface mating with an upper surface of the blade, and an upper shoulder, the upper shoulder extending upwardly from the lower surface of the upper portion and outwardly from a longitudinal axis of the cleat;

the cleats being formed of an integral, rigid material and being collectively configured to provide a substantially rigid interface between the pre-finished blade and a removable handle of the pre-finished blade.

2. The trowel blade of claim 1, further comprising a series of irregularities formed in internal sides of the apertures, the irregularities being configured to engage the lower portion of the cleat when the lower portion is deformed within the aperture to resist rotation of the lower portion within the aperture.

3. The blade of claim 1, wherein the deformed lower portion of the cleats is contained substantially fully between a plane defined by a top surface of the pre-finished blade and a plane defined by a bottom surface of the pre-finished blade.

4. The blade of claim 1, wherein a lower surface of the lower portion of the cleats is recessed in the aperture above a plane defined by a bottom of the pre-finished blade.

5. The blade of claim 1, wherein a lower surface of the lower portion of the cleats is parallel to a plane defined by a bottom of the pre-finished blade.

6. The blade of claim 1, wherein the cleats are deformed within the apertures in a tensioned state such that the cleats are held substantially immobile with respect to the blade.

7. A trowel blade, comprising:

a pre-finished, hardened and tempered blade having at least two apertures formed therethrough, each aperture being circumscribed by an upwardly protruding dimple formed in the pre-finished blade;

at least two cleats, each cleat being disposed in one of the apertures, each cleat having:

a lower portion, deformed within the dimple to have a frusto-conical shape mating with a bottom surface of the dimple; and an upper, inverted frusto-conical portion having a lower surface mating with a top surface of the dimple, and an upper shoulder, the upper shoulder extending upwardly from the lower surface of the upper portion and outwardly from a longitudinal axis of the cleat;

the cleats being formed of an integral, rigid material and being collectively configured to provide a substantially rigid interface between the pre-finished blade and a removable handle of the pre-finished blade.

8. The blade of claim 7, wherein the deformed lower portion of the cleats is contained substantially fully between a plane defined by a top surface of the pre-finished blade and a plane defined by a bottom surface of the pre-finished blade.

9. The blade of claim 7, wherein a lower surface of the lower portion of the cleats is disposed in the dimple above a plane defined by a bottom of the pre-finished blade.

10. The blade of claim 7, wherein a lower surface of the lower portion of the cleats is parallel with a plane defined by a bottom of the pre-finished blade.

11. The blade of claim 7, wherein the cleats are deformed within the dimples in a tensioned state such that the cleats are held substantially immobile with respect to the blade.

12. The blade of claim 7, wherein the upper portion of each cleat includes an internal, tapered recess defining the lower surface thereof, the internal, tapered recess mating with the top surface of the upwardly protruding dimple formed in the pre-finished blade.

* * * * *